US006589010B2

(12) United States Patent
Itzel et al.

(10) Patent No.: US 6,589,010 B2
(45) Date of Patent: Jul. 8, 2003

(54) METHOD FOR CONTROLLING COOLANT FLOW IN AIRFOIL, FLOW CONTROL STRUCTURE AND AIRFOIL INCORPORATING THE SAME

(75) Inventors: Gary Michael Itzel, Simpsonville, SC (US); Robert Henry Devine, II, Simpsonville, SC (US); Sanjay Chopra, Greenville, SC (US); Thomas Nelson Toornman, Buford, GA (US)

(73) Assignee: General Electric Company, Schenectady, NY (US)

( * ) Notice: Subject to any disclaimer, the term of this patent is extended or adjusted under 35 U.S.C. 154(b) by 23 days.

(21) Appl. No.: 09/682,373

(22) Filed: Aug. 27, 2001

(65) Prior Publication Data

US 2003/0039537 A1 Feb. 27, 2003

(51) Int. Cl.[7] ..... F01D 9/06
(52) U.S. Cl. ..... 415/115; 415/1; 416/96 R
(58) Field of Search ..... 415/1, 115, 208.2, 415/221.2; 416/96 R, 97 R

(56) References Cited

U.S. PATENT DOCUMENTS

| | | | | |
|---|---|---|---|---|
| 3,628,880 A | * | 12/1971 | Smuland | 415/115 |
| 4,379,677 A | | 4/1983 | Hallinger et al. | |
| 5,145,315 A | | 9/1992 | North et al. | |
| 5,217,347 A | | 6/1993 | Miraucourt et al. | |
| 5,253,976 A | | 10/1993 | Cunha | |
| 5,320,483 A | | 6/1994 | Cunha et al. | |
| 5,320,485 A | * | 6/1994 | Bourguignon et al. | 415/115 |
| 5,634,766 A | | 6/1997 | Cunha et al. | |
| 5,685,693 A | | 11/1997 | Sexton et al. | |
| 5,743,708 A | * | 4/1998 | Cunha et al. | 415/115 |
| 6,398,486 B1 | * | 6/2002 | Storey et al. | 415/115 |
| 6,422,810 B1 | * | 7/2002 | Burdgick et al. | 415/115 |
| 6,468,031 B1 | * | 10/2002 | Yu et al. | 415/115 |

OTHER PUBLICATIONS

"39$^{th}$ GE Turbine State–of–the–Art Technology Seminar", Tab 1,""F" Technology—the First Half Million Operating Hours", H.E. Miller, Aug. 1996.
"39$^{th}$ GE Turbine State–of–the–Art Technology Seminar", Tab 2, "GE Heavy–Duty Gas Turbine Performance Characteristics", F. J. Brooks, Aug. 1996.
"39$^{th}$ GE Turbine State–of–the–Art Technology Seminar", Tab 3, "9EC 50Hz 170–MW Class Gas Turbine", A.S. Arrao, Aug. 1996.
"39$^{th}$ GE Turbine State–of–the–Art Technology Seminar", Tab 4, "MWS6001FA—An Advanced–Technology 70–MW Class 50/60 Hz Gas Turbine", Ramachandran et al., Aug. 1996.
"39$^{th}$ GE Turbine State–of–the–Art Technology Seminar", Tab 5, "Turbomachinery Technology Advances at Nuovo Pignone", Benvenuti et al., Aug. 1996.
"39$^{th}$ GE Turbine State–of–the–Art Technology Seminar", Tab 6, "GE Aeroderivative Gas Turbines—Design and Operating Features", M.W. Horner, Aug. 1996.
"39$^{th}$ GE Turbine State–of–the–Art Technology Seminar", Tab 7, "Advance Gas Turbine Materials and Coatings", P.W. Schilke, Aug. 1996.

(List continued on next page.)

*Primary Examiner*—Edward K. Look
*Assistant Examiner*—James M McAleenan
(74) *Attorney, Agent, or Firm*—Nixon & Vanderhye PC

(57) ABSTRACT

A coolant flow control structure is provided to channel cooling media flow to the fillet region defined at the transition between the wall of a nozzle vane and a wall of a nozzle segment, for cooling the fillet region. In an exemplary embodiment, the flow control structure defines a gap with the fillet region to achieve the required heat transfer coefficients in this region to meet part life requirements.

25 Claims, 5 Drawing Sheets

OTHER PUBLICATIONS

"39th GE Turbine State–of–the–Art Technology Seminar", Tab 8, "Dry Low $NO_x$ Combustion Systems for GE Heavy–Duty Turbines", L. B. Davis, Aug. 1996.
"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems, for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines, "J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, Vol. 2–Industrial Machine, Mar. 31, 1997, Morgantown, WV.
"Advanced Turbine Systems (ATS Program) Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Numbers DE–FC21–95MC31176–11.
"Exhibit panels used at 1995 product introduction at PowerGen Europe".

"Extensive Testing Program Validates High Efficiency, reliability of GE's Advanced "H" Gas Turbine Technology", Press Information, Press Release, 96–NR14, Jun. 26, 1996, H Technology Tests pp. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp.1–6.

"Gas, Steam Turbine Work as Single Unit in GE's Advanced H Technology Combined–Cycle System", Press Information, Press Release, 95–NR18, May 16, 1995, Advanced Technology Introduction/pp. 1–3.

"GE Breaks 60% Net Efficiency Barrier" paper, 4 pages.

"GE Businesses Share Technologies and Experts to Develop State–Of–The–Art Products", Press Information, Press Release 95–NR10, May 16, 1995, GE Technology Transfer/pp. 1–3.

"General Electric ATS Program Technical Review, Phase 2 Activities", T. Chance et al., pp. 1–4.

"General Electric's DOE/ATS H Gas Turbine Development" Advanced Turbine Systems Annual Review Meeting, Nov. 7–8, 1996, Washington, D.C., Publication Release.

"H Technology Commercialization", 1998 MarComm Activity Recommendation, Mar., 1998.

"H Technology", Jon Ebacher, VP, Power Gen Technology, May 8, 1998.

"H Testing Process", Jon Ebacher, VP, Power Gen Technology, May 8, 1998.

"Heavy–Duty & Aeroderivative Products" Gas Turbines, Brochure, 1998.

"MS7001H/MS9001H Gas Turbine, gepower.com website for PowerGen Europe" Jun. 1–3 going public Jun. 15, (1995).

"New Steam Cooling System is a Key to 60% Efficiency for GE "H" Technology Combined–Cycle Systems", Press Information, Press Release, 95–NRR16, May 16, 1995, H Technology/pp. 1–3.

"Overview of GE's H Gas Turbine Combined Cycle", Jul. 1, 1995 to Dec. 31, 1997.

"Power Systems for the 21$^{st}$Century —"H" Gas Turbine Combined Cycles", Thomas C. Paul et al., Report.

"Power–Gen '96 Europe", Conference Programme, Budapest, Hungary, Jun. 26–28, 1996.

"Power–Gen International", 1998 Show Guide, Dec. 9–11, 1998, Orange County Convention Center, Orlando, Florida.

"Press Coverage following 1995 product announcement"; various newspaper clippings relating to improved generator.

"Proceedings of the Advanced Turbine Systems Annual Program Review Meeting", vol. I, "Industrial Advanced Turbine Systems Program Overview", D.W. Esbeck, pp. 3–13, Oct., 1995.

"Proceedings of the Advanced Turbine Systems Annual Program Review Meeting", vol. I, "H Gas Turbine Combined Cycle", J. Corman, pp. 14–21, Oct., 1995.

"Proceedings of the Advanced Turbine Systems Annual Program Review Meeting", vol. I, "Overview of Westinghouse's Advanced Turbine Systems Program", Bannister et al., pp. 22–30, Oct., 1995.

"Proceedings of the Advanced Turbine Systems Annual Program Review Meeting", vol. I, "Allison Engine ATS Program Technical Review", D. Mukavetz, pp. 31–42, Oct., 1995.

"Proceedings of the Advanced Turbine Systems Annual Program Review Meeting", vol. I, "Advanced Turbine Systems, Program Industrial System Concept Development", S. Gates, pp. 43–63, Oct., 1995.

"Proceedings of the Advanced Turbine Systems Annual Program Review Meeting", vol. I, "Advanced Turbine System Program Phase 2 Cycle Selection", Latcovich, Jr., pp. 64–69, Oct., 1995.

"Proceedings of the Advanced Turbine Systems Annual Program Review Meeting", vol. I, "General Electric ATS Program Technical Review Phase 2 Activities", Chance et al., pp. 70–74, Oct., 1995.

"Proceedings of the Advanced Turbine Systems Annual Program Review Meeting", vol. I, "Technical Review of Westinghouse's Advanced Turbine Systems Program", Diakunchak et al., pp. 75–86, Oct., 1995.

"Proceedings of the Advanced Turbine Systems Annual Program Review Meeting", vol. I, "Advanced Combustion Turbines and Cycles: An EPRI Perspective", Touchton et al., pp. 87–88, Oct., 1995.

"Proceedings of the Advanced Turbine Systems Annual Program Review Meeting", vol. I, "Advanced Turbine Systems Annual Program Review", William E. Koop, pp. 89–92, Oct., 1995.

"Proceedings of the Advanced Turbine Systems Annual Program Review Meeting", vol. I, "The AGTSR Consortium: An Update", Fant et al., pp. 93–102, Oct., 1995.

"Proceedings of the Advanced Turbine Systems Annual Program Review Meeting", vol. I, "Overview of Allison/AGTSR Interactions", Sy A. Ali, pp. 103–106, Oct., 1995.

"Proceedings of the Advanced Turbine Systems Annual Program Review Meeting", vol. I, "Design Factors for Stable Lean Premix Combustion", Richards et al., pp. 107–113, Oct., 1995.

"Proceedings of the Advanced Turbine Systems Annual Program Review Meeting", vol. I, "Ceramic Stationary as Turbine", M. van Roode, pp. 114–147, Oct., 1995.

"Proceedings of the Advanced Turbine Systems Annual Program Review Meeting", vol. I, "DOE/Allison Ceramic Vane Effort", Wenglarz et al., pp. 148–151, Oct., 1995.

"Proceedings of the Advanced Turbine Systems Annual Program Review Meeting", vol. I, "Materials/Manufacturing Element of the Advanced Turbine Systems Program", Karnitz et al., pp. 152–160, Oct., 1995.

"Proceedings of the Advanced Turbine Systems Annual Program Review Meeting", vol. I, "Land–Based Turbine Casting Initiative", Mueller et al., pp. 161–170, Oct., 1995.

"Proceedings of the Advanced Turbine Systems Annual Program Review Meeting", vol. I, "Turbine Airfoil Manufacturing Technology", Kortovich, pp. 171–181, Oct., 1995.

"Proceedings of the Advanced Turbine Systems Annual Program Review Meeting", vol. I, "Pratt & Whitney Thermal Barrier Coatings", Bornstein et al., pp. 182–193, Oct., 1995.

"Proceedings of the Advanced Turbine Systems Annual Program Review Meeting", vol. I, "Westinhouse Thermal Barrier Coatings", Goedjen et al., pp. 194–199, Oct., 1995.

"Proceedings of the Advanced Turbine Systems Annual Program Review Meeting", vol. I, "High Performance Steam Development", Duffy et al., pp. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., pp. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct., 1995.

"Proceedings of the Advanced Turbine Systems Annual Program Review Meeting", vol. II, "Lean Premixed Flames for Low $No_x$ Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., pp. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct., 1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., pp. 410–414, Oct., 1995.

"Proceedings of the Advanced Turbine Systems Annual Program Review Meeting, vol. II", The Role of Reactant Unmixedness, Strain Rate, and Length Scale on Premixed Combustor Performance, Samuelsen et al., pp. 415–422, Oct., 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatibility of Gas Turbine Materials with Stem Cooling", Desai et al., pp. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement"M. K. Chyu, pp. 465–473, Oct., 1995.

"Proceedings of the Advanced Turbine Systems Annual Program Review Meeting", vol. II, Effects of Geometry on Slot–Jet Film Cooling Performance, Hyams et al., pp. 474–496 Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515 Oct., 1995.

"Proceedings of the Advanced Turbine Systems Annual Program Review Meeting", vol. II, "Premixed Burner Experiments: Geometry, Mixing, and Flame Structure Issues", Gupta et al., pp. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., pp. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, pp. 3–16, Nov., 1996.

"Proceedings of the Advanced Turbine Systems Annual Program Review Meeting", "Power Needs in the Chemical Industry", Keith Davidson, pp. 17–26, Nov., 1996.

"Proceedings of the Advanced Turbine Systems Annual Program Review Meeting", "Advanced Turbine Systems Program Overview", David Esbeck, pp. 27–34, Nov., 1996.

"Proceedings of the Advanced Turbine Systems Annual Program Review Meeting", "Westinghouse's Advanced Turbine Systems Program", Gerard McQuiggan, pp. 35–48, Nov., 1996.

"Proceedings of the Advanced Turbine Systems Annual Program Review Meeting", "Overview of GE's H Gas Turbine Combined Cycle", Cook et al., pp. 49–72, Nov., 1996.

"Proceedings of the Advanced Turbine Systems Annual Program Review Meeting", "Allison Advanced Simple Cycle Gas Turbine System", William D. Weisbrod, pp. 73–94, Nov., 1996.

"Proceedings of the Advanced Turbine Systems Annual Program Review Meeting", "The AGTSR Industry–University Consortium", Lawrence P. Golan, pp. 95–100, Nov., 1996.

"Proceedings of the Advanced Turbine Systems Annual Program Review Meeting", "$NO_X$ and CO Emissions Models for Gas–Fired Lean–Premixed Combustion Turbines", A. Mellor, p. 111–122, Nov., 1996.

"Proceedings of the Advanced Turbine Systems Annual Program Review Meeting", "Methodologies for Active Mixing and Combustion Control", Uri Vandsburger, pp. 123–156, Nov., 1996.

"Proceedings of the Advanced Turbine Systems Annual Program Review Meeting", "Combustion Modeling in Advanced Gas Turbine Systems", Paul O. Hedman, pp. 157–180, Nov., 19967.

"Proceedings of the Advanced Turbine Systems Annual Program Review Meeting", "Manifold Methods for Methane Combustion", Stephen B. Pope, pp. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, pp. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov., 1996.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", "Active Control of Combustion Instabilities in Low $NO_X$ Turbines", Ben T. Zinn, pp. 253–264, Nov., 1996.

"Proceedings of the Advanced Turbine Systems Annual Program Review Meeting", "Life Prediction of Advanced Materials for Gas Turbine Application," Sam Y. Zamrik, pp. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov., 1996.

"Proceedings of the Advanced Turbine Systems Annual Program Review Meeting", "Compatibility of Gas Turbine Materials with Steam Cooling", Vimal Desai, pp. 291–314, Nov., 1996.

"Proceedings of the Advanced Turbine Systems Annual Program Review Meeting", "Bond Strength and Stress Measurements in Thermal Barrier Coatings", Maurice Gell, pp. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov., 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov., 1996.

"Proceedings of the Advanced Turbine Systems Annual Program Review Meeting", "Improved Modeling Techniques for Turbomachinery Flow Fields", B. Lakshiminarayana, pp. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov., 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov., 1996.

"Proceedings of the Advanced Turbine Systems Annual Program Review Meeting", "Steam as a Turbine Blade Coolant: External Side Heat Transfer", Abraham Engeda, pp. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.

"Proceedings of the Advanced Turbine Systems Annual Program Review Meeting", "Closed–Loop Mist/Steam Cooling for Advanced Turbine Systems", Ting Wang, pp. 499–512, Nov., 1996.

"Proceedings of the Advanced Turbine Systems Annual Program Review Meeting", "Heat Pipe Turbine Vane Cooling", Langston et al., pp. 513–534, Nov., 1996.

"Proceedings of the Advanced Turbine Systems Annual Program Review Meeting", "EPRI's Combustion Turbine Program: Status and Future Directions", Arthur Cohn, pp. 535–552, Nov., 1996.

"Proceedings of the Advanced Turbine Systems Annual Program Review Meeting", "ATS Materials Suport", Michael Karnitz, pp. 553–576, Nov., 1996.

"Proceedings of the Advanced Turbine Systems Annual Program Review Meeting", "Land Based Turbine Casting Initiative", Boyd A. Meuller, pp. 577–592, Nov., 1996.

"Proceedings of the Advanced Turbine Systems Annual Program Review Meeting", "Turbine Airfoil Manufacturing Technology", Charles S. Kortovich, pp. 593–622, Nov., 1996.
"Proceedings of the Advanced Turbine Systems Annual Program Review Meeting", "Hot Corrosion Testing of TBS's", Norman Bornstein, pp. 623–631, Nov., 1996.
"Proceedings of the Advanced Turbine Systems Annual Program Review Meeting", "Ceramic Stationary Gas Turbine", Mark van Roode, pp. 633–658, Nov., 1996.
"Proceedings of the Advanced Turbine Systems Annual Program Review Meeting", "Western European Status of Ceramics for Gas Turbines", Tibor Bornemisza, pp. 659–670, Nov., 1996.
"Proceedings of the Advanced Turbine Systems Annual Program Review Meeting", "Status of Ceramic Gas Turbines in Russia", Mark van Roode, pp. 671, Nov., 1996.
"Status Report: The U.S. Department of of Energy's Advanced Turbine Systems Program", facsimile dated Nov. 7, 1996.
"Testing Program Results Validate GE's H Gas Turbine—High Efficiency, Low Cost of Eelctricity and Low Emissions", Roger Schonewald and Patrick Marolda, (no date available).
"Testing Program Results Validate GE's Gas Turbine—High Efficiency, Low Cost of Eelctricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Numbers: DOE/MC/31176–5628.
"Utility Advanced Turbine System (ATS) Technology Readiness Testing—Phase 3", Document #666274 Oct. 1, 1996–Sep. 30, 1997, Publication Date, Dec. 31, 1997, Report Numbers: DOE/MC/31176–10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Numbers: DOE/MC/31176 5340.
"Utility Advanced Turbine System (ATS) Technology Readiness Testing and Pre–Commercial Demonstration, Phase 3", Document #486132, Apr. 1–Jun. 30, 1976, Publication Date, Dec. 31, 1996, Report Numbers: DOE/MC/31176–5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Numbers: DOE/MC31176–5339.
"Utility Advanced Turbine System (ATS) Technology Readiness Testing and Pre–Commercial Demonstration," Document #666277, Apr. 1–Jun. 30, 1997, Publication Date, Dec. 31, 1997, Report Numbers: DOE/MC/31176–8.
"Utility Advanced Turbine System (ATS) Technology Readiness Testing and Pre–Commercialization Demonstration"Jan. 1–Mar. 31, 1996, DOE/MC/31176–5338.
"Utility Advanced Turbine System (ATS) Technology Readiness Testing: Phase 3R", Document #756552, Apr. 1–Jun. 30, 1999, Publication Date, Sep. 1, 1999, Report Numbers: DE–FC21–95MC31176–23.
"Utility Advanced Turbine System (ATS) Technology Readiness Testing.", Document #656823, Jan. 1–Mar. 31, 1998, Publication Date, Aug. 1, 1998, Report Numbers: DOE/MC/31176–17.
"Utility Advanced Turbine System (ATS) Technology Readiness Testing and Pre–Commercial Demonstration", Annual Technical Progress Report, Reporting Period: Jul. 1, 1995–Sep. 30, 1996.
"Utility Advanced Turbine System (ATS) Technology Readiness Testing", Phase 3R, Annual Technical Progress Report, Reporting Period: Oct. 1, 1997–Sep. 30, 1998.
"Utility Advanced Turbine System (ATS) Technology Readiness Testing", Document #750405, Oct. 1–Dec. 30, 1998, Publication Date: May, 1, 1999, Report Numbers: DE–FC21–95MC31176–20.
"Utility Advanced Turbine System (ATS) Technology Readiness Testing", Document #1348, Apr. 1–Jun. 29, 1998, Publication Date Oct. 29, 1998, Report Numbers DE–FC21–95MC31176–18.
"Utility Advanced Turbine System (ATS) Technology Readiness Testing—Phase 3", Annual Technical Progress Report, Reporting Period: Oct. 1, 1996–Sep. 30, 1997.
"Utility Advanced Turbine System (ATS) Technology Readiness Testing and Pre–Commercial Demonstration", Quarterly Report, Jan. 1–Mar. 31, 1997, Document #666275, Report Numbers: DOE/MC/31176–07.
"Proceedings of the 1997 Advanced Turbine Systems", Annual Program Review Meeting, Oct. 28–29, 1997.
U.S. Application No. 09/585,840 of Storey et al; filed Jun. 1, 2000.

* cited by examiner

METHOD FOR CONTROLLING COOLANT FLOW IN AIRFOIL, FLOW CONTROL STRUCTURE AND AIRFOIL INCORPORATING THE SAME

FEDERAL RESEARCH STATEMENT

[Federal Research Statement Paragraph] This invention was made with Government support under Contract No. DE-FC21-95MC31176 awarded by the Department of Energy. The Government has certain rights in this invention.

BACKGROUND OF INVENTION

The present invention relates generally to gas turbines, for example, for electrical power generation and more particularly to the control of coolant flow to effectively cool the fillet region of the nozzle airfoils of the turbine.

Gas turbines typically include a compressor section, a combuster and a turbine section. The compressor section draws ambient air and compresses it. Fuel is added to the compressed air in the combustor and the air-fuel mixture is ignited. The resultant hot fluid enters the turbine section where energy is extracted by turbine blades, which are mounted to a rotatable shaft. The rotating shaft drives the compressor in the compressor section and drives, e.g., a generator for generating electricity or is used for other functions. The efficiency of energy transfer from the hot fluid to the turbine blades is improved by controlling the angle of the path of the gas onto the turbine blades using non-rotating airfoil shaped vanes or nozzles. These airfoils direct the flow of hot gas or fluid from a merely parallel flow to a generally circumferential flow onto the blades. Since the hot fluid is at very high temperatures when it comes into contact with the airfoil, the airfoil is necessarily subject to high temperatures for long periods of time. Thus, in conventional gas turbines, the airfoils are generally internally cooled, for example by directing a coolant through the airfoil.

Inside the airfoil, ribs are conventionally provided to extend between the convex and concave sides of the airfoil to provide mechanical support between the concave and convex sides of the airfoil. The ribs are needed to maintain the integrity of the nozzle and reduce ballooning stresses on the airfoil pressure and suction surfaces. The ballooning stresses are a result of pressure differences between the internal and external walls of the airfoil. The ribs define multiple cavities in the airfoil which define at least part of the coolant flow path(s) through the airfoil. The cavities may be cooled by impingement, using impingement inserts, or convection with or without turbulators on the ribs and/or airfoil walls. However, it is difficult to achieve the required cooling effectiveness in the airfoil to sidewall fillet regions at the exit end of the airfoil cavities. If the cavity is impingement cooled, the inserts cannot flare out to maintain the required impingement cooling gap due to insertability constraints. If this region is convectively cooled, due to the large flow area, the heat transfer coefficient are not sufficient to produce the required part life in this area. Therefore, previous designs using compressed air-cooling techniques would use film cooling to cool this region.

In advanced gas turbine designs, it has been recognized that the temperature of the hot gas flowing past the turbine components could be higher than the melting temperature of the metal. It has therefore been necessary to establish cooling schemes that more assuredly protect the hot gas components during operation. In this regard, steam has been demonstrated to be a preferred cooling media for gas turbine nozzles (stator vanes), particularly for combined-cycle plants. See for example, U.S. Pat. No. 5,253,976, the disclosure of which is incorporated herein by this reference. However, because steam has a higher heat capacity than the combustion gas, it is inefficient to allow the coolant steam to mix with the hot gas stream. Consequently, it is desirable to maintain cooling steam inside the hot gas path components in a closed circuit. Accordingly, in such a closed loop cooling system, film cooling of the fillet region is not permitted, so that effective cooling of this region remains problematic.

SUMMARY OF INVENTION

As noted above, significant backside cooling is required in turbine airfoils in the fillet region where the airfoil connects to the sidewall in order for the part to meet part life requirements. A design is required to achieve the desired cooling efficiency while minimizing the amount of cooling flow required. Also, downstream cooling of other areas on the airfoil sidewall must not be disturbed.

The present invention is embodied in a coolant flow control structure that channels cooling media flow to the fillet region. More particularly, the invention may be embodied in a flow control structure that defines a gap with the fillet region to achieve the required heat transfer coefficients in this region to meet the part life requirements.

Thus, in first aspect of the invention a flow control structure is provided for channeling cooling media flow to a fillet region defined at a transition between a wall of a nozzle vane and a wall of a nozzle segment, for cooling the fillet region, the flow control structure comprising: a base; and a main body, the main body being configured to define a crest generally at a transverse mid portion of the base and to define sloped walls from the crest toward longitudinal side edges of the base, thereby to define a gap with the fillet region to channel coolant flow along the fillet region.

According to another aspect of the invention, a turbine vane segment is provided for forming part of a nozzle stage of a turbine, the vane segment comprising: inner and outer walls spaced from one another; a turbine vane extending between the inner and outer walls and having leading and trailing edges, the vane including a plurality of discrete cavities between the leading and trailing edges and extending lengthwise of the vane for flowing a cooling medium through the vane; a plenum defined adjacent one of the inner and outer walls, at least one of the cavities of the vane being in flow communication with the plenum via an opening at a radial end of the vane to enable passage of cooling medium from the at least one cavity into the plenum; and a flow control structure for channeling cooling media flow to a fillet region defined at a transition between a wall of the vane and the one wall for cooling the fillet region.

According to yet a further aspect of the invention, a method of cooling the fillet region of a nozzle is provided that comprises: providing a nozzle vane segment including inner and outer walls spaced from one another; a turbine vane extending between the inner and outer walls and having leading and trailing edges, the vane including a plurality of discrete cavities between the leading and trailing edges and extending lengthwise of the vane for flowing a cooling medium through the vane; and a plenum defined adjacent one of the inner and outer walls, at least one of the cavities of the vane being in flow communication with the plenum via an opening at a radial end of the vane to enable passage of cooling medium from the at least one cavity into the plenum; disposing a flow control structure at the opening; flowing coolant medium through the cavity; channeling the flowing coolant medium at the outlet with the flow control structure to a fillet region defined at a transition between a wall of the vane and the one wall for cooling the fillet region.

BRIEF DESCRIPTION OF DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION

Figure 1:
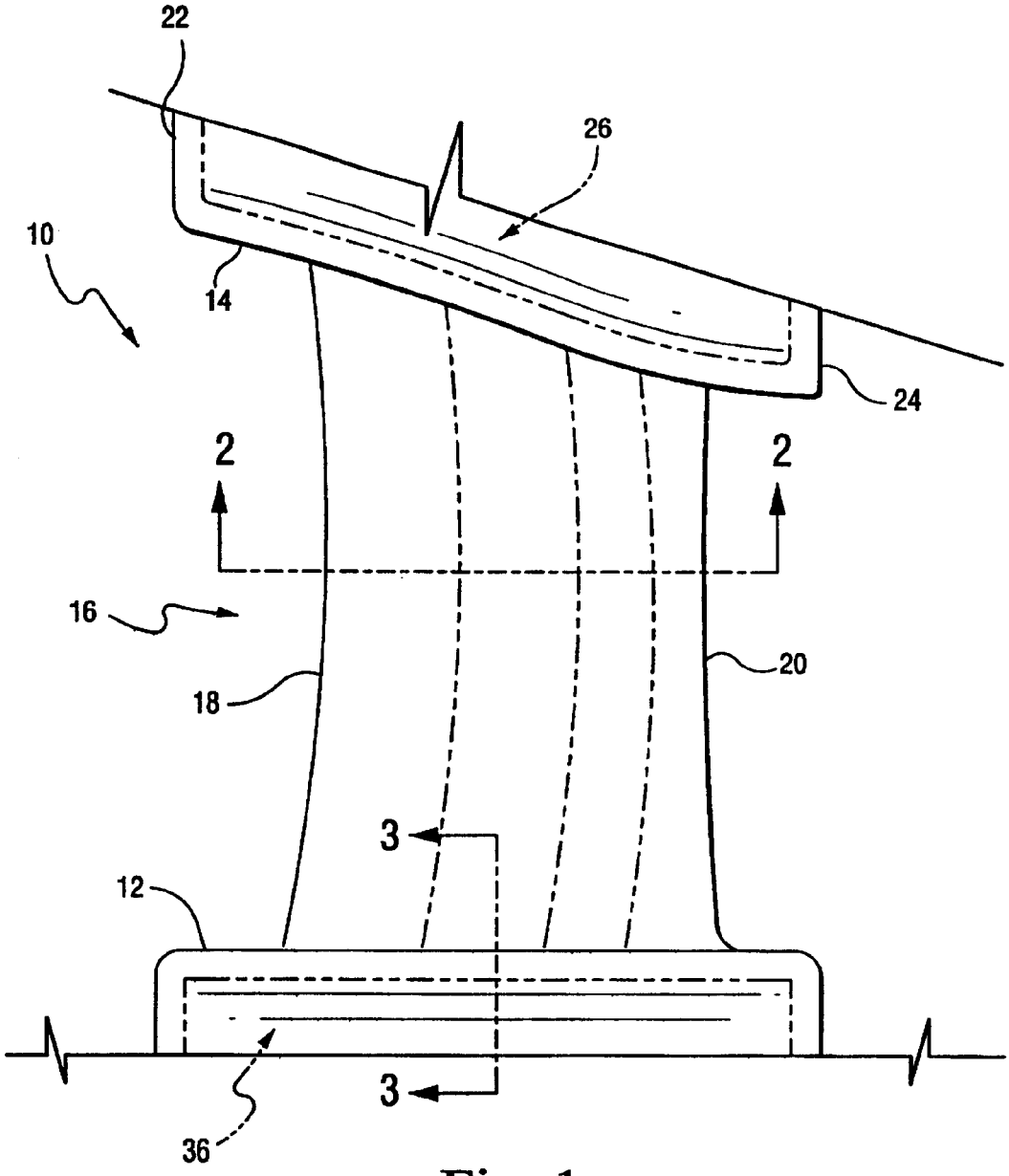
FIG. 1 is a schematic elevational view of a nozzle vane in which a cooling media exit flow splitter embodying the invention may be provided.
Figure 2:
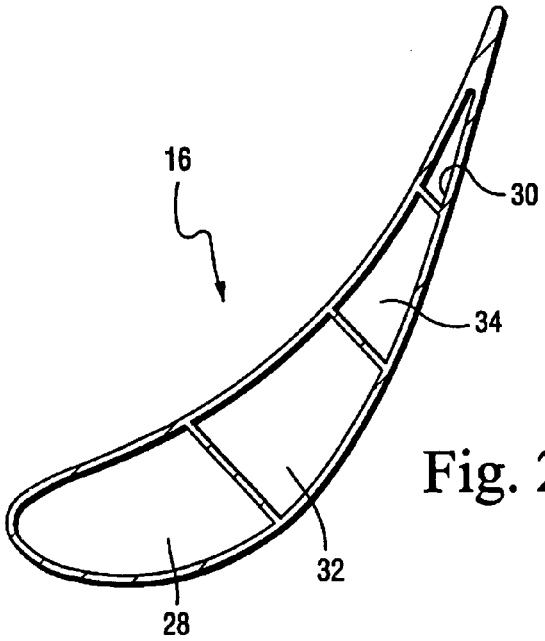
FIG. 2 is a schematic cross sectional view of the nozzle vane, taken along lines 2—2 of FIG. 1.

As summarized above, the present invention relates in particular to cooling circuits for, e.g., the first stage nozzles of a turbine, reference being made to the previously identified Patent for a disclosure of various other aspects of the turbine, its construction and methods of operation. Referring now to FIG. 1, there is schematically illustrated in side elevation a vane segment 10 comprising one of the plurality of circumferantially arranged segments of e.g., the first stage nozzle. It will be appreciated that the segments are connected one to the other to form an annular array of segments defining the hot gas path through the first stage nozzle of the turbine. Each segment includes radially spaced inner and outer walls 12, 14 with one or more nozzle vanes 16 extending between the outer and inner walls. The segments are supported about the axis of the turbine (not shown) with the adjoining segments being sealed one to the other. For purposes of this description, the vane 16 will be described as forming the sole vane of a segment.

As shown in this schematic illustration of FIG. 1, the vane 16 has a leading edge 18 and a trailing edge 20, outer side railings (not shown), a leading railing 22 and a trailing railing 24 defining a plenum 26 with an outer cover plate (not shown) and having an impingement plate (not shown) disposed in the plenum in spaced relation to the outer wall for impingement cooling of the same. As used herein, the terms outwardly and inwardly or outer or inner refer to a generally radial direction with respect to the axis of the turbine.

In this exemplary embodiment, the nozzle vane 16 has a plurality of cavities for example, a leading edge cavity 28, a trailing edge cavity 30 and intermediate cavities 32, 34. Although the invention is not limited to the number and configuration of cavities shown.

Coolant flows from the outer plenum 26 through one or more of the nozzle cavities 28, 30, 32, 34 for impingement and/or convection cooling and into an inner plenum 36 defined by the inner wall 12 and a lower cover plate (not shown). Structural ribs 38 are integrally cast with the inner wall for supporting an inner side wall impingement plate 40 in spaced relation to the inner side wall. The post impingement coolant flows through the remaining, return cavities to a steam outlet (not shown). In the illustrated, exemplary embodiment, four cavities are provided for cooling steam flow. For discussion purposes only, the first, leading edge cavity 28 and the second, intermediate cavity 32 will be referred to as radially inward, down-flow cavities and the third and fourth cavities 34, 30 will be referred to as radially outward, coolant return cavities.

As noted above, the present invention was developed in particular for purposes of cooling, for example steam cooling, robustness in the area of the airfoil fillet of the nozzle vane. The invention relates in particular to the provision and configuration of a flow splitter that achieves the desired cooling in the fillet region of the vane while minimizing the amount of cooling flow required.

Figure 4:
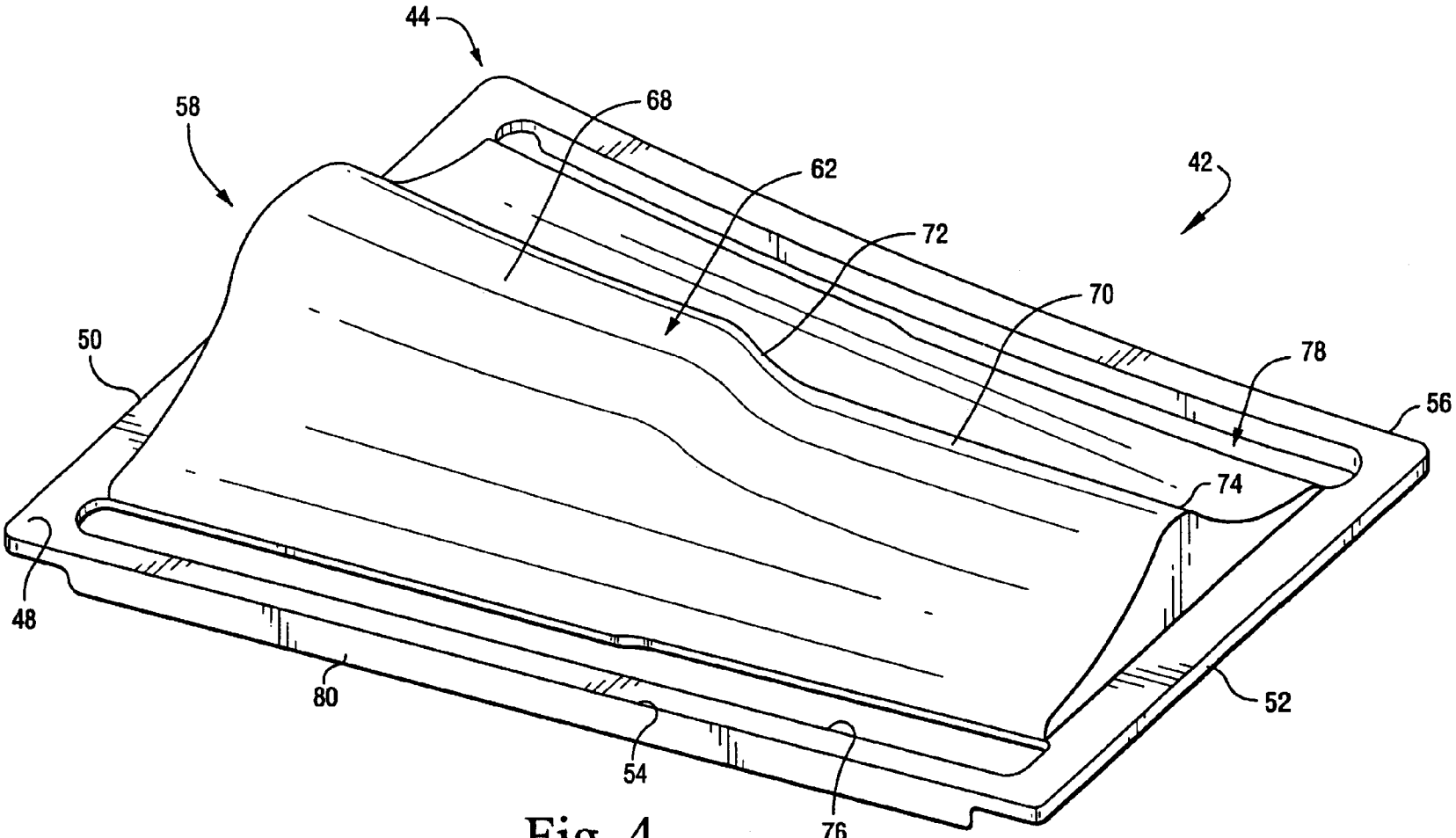
FIG. 4 is a perspective view of an exemplary coolant flow splitter structure embodying the invention.
Figure 5:
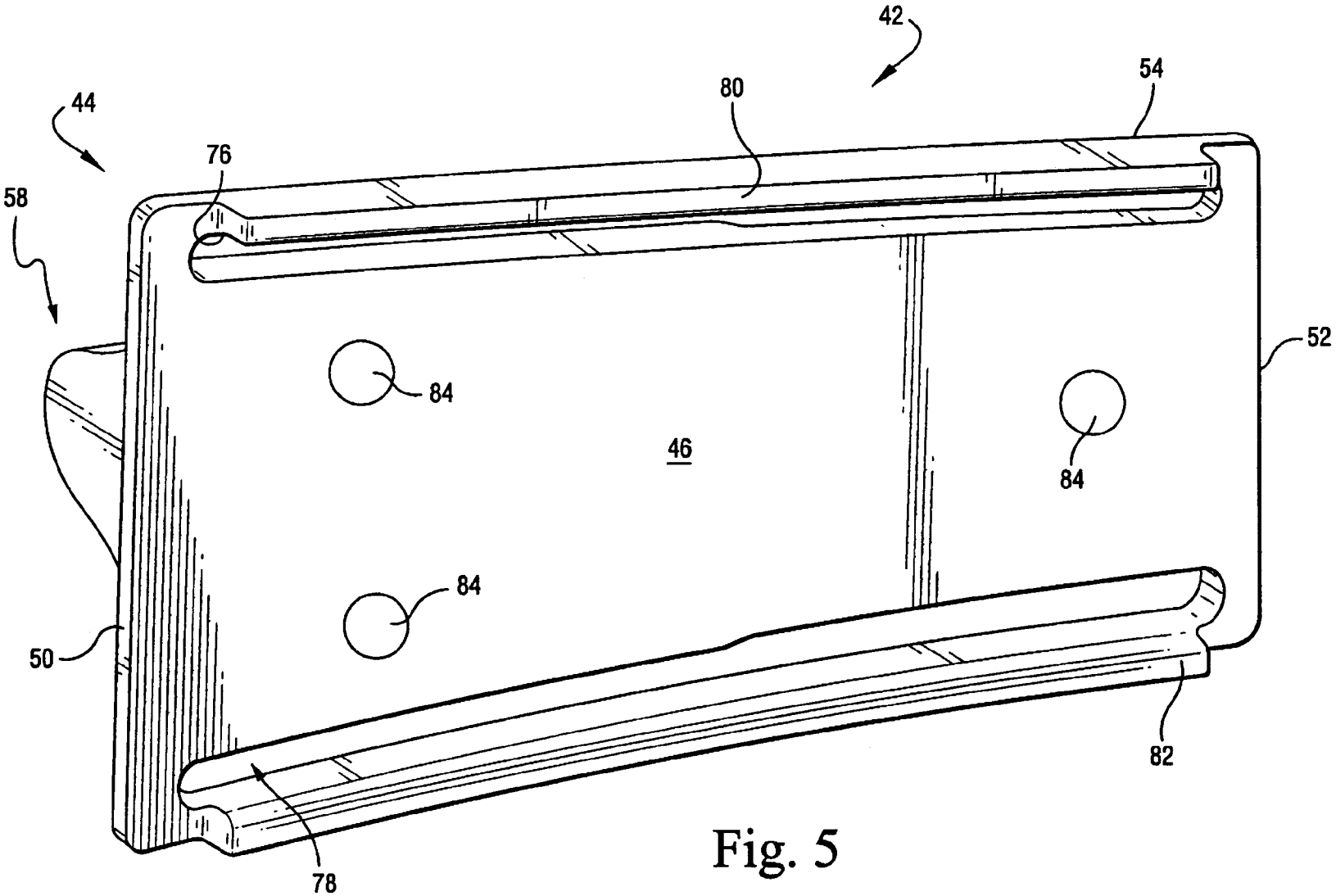
FIG. 5 is a perspective view from below of the flow splitter component of FIG. 4.
Figure 6:
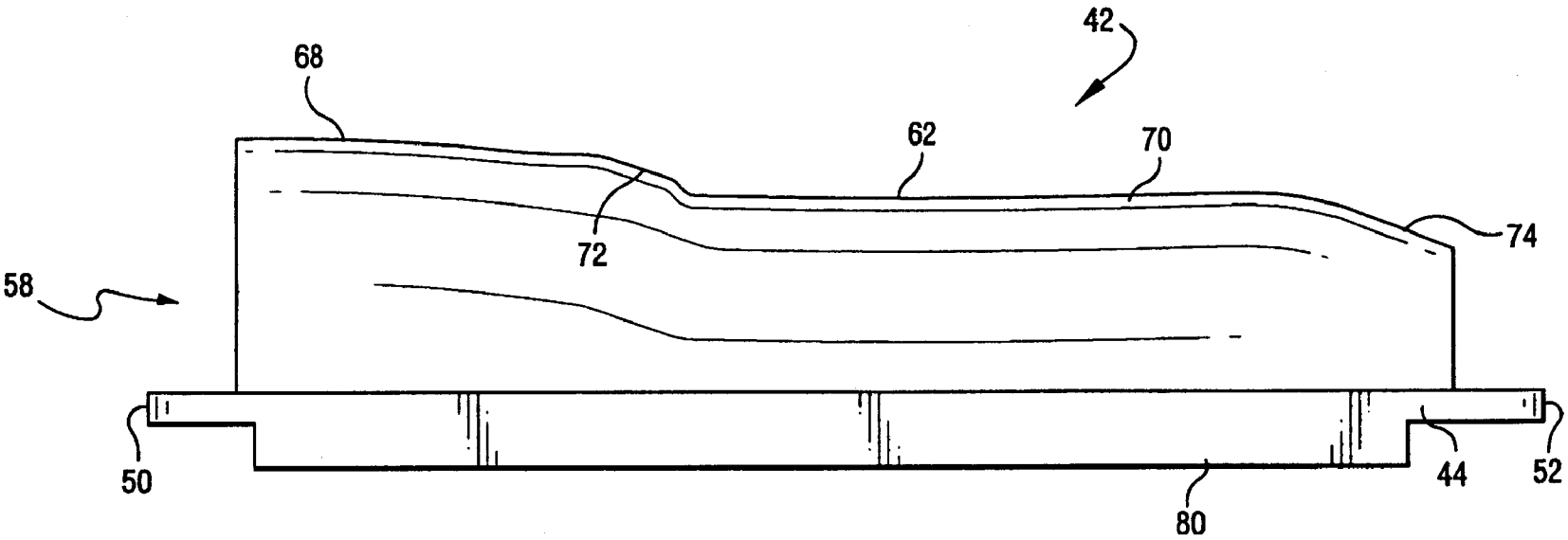
FIG. 6 is a schematic side elevational view of the flow splitter of FIGS. 4 and 5.

An exemplary embodiment of a coolant flow splitter 42 is shown in FIGS. 4–6. In the illustrated embodiment, the flow splitter is mounted to the exit end of the second, intermediate coolant cavity 32 of the airfoil although it is to be understood that a flow splitter embodying the invention may be mounted to the exit end of any coolant cavity where enhanced cooling of the fillet region is deemed necessary or desirable.

The flow splitter 42 includes a base 44 for mounting the flow splitter with respect to the airfoil cavity 32. The base has a bottom or inner face 46 and an outer face 48, a leading end 50 and a trailing end 52, and longitudinal side edges 54, 56 extending therebetween. As schematically illustrated in FIG. 3, in an exemplary embodiment, the flow splitter structure 42 is secured by its base 44 to the structural ribs 38 that are integrally cast with the inner wall 12.

Figure 3:
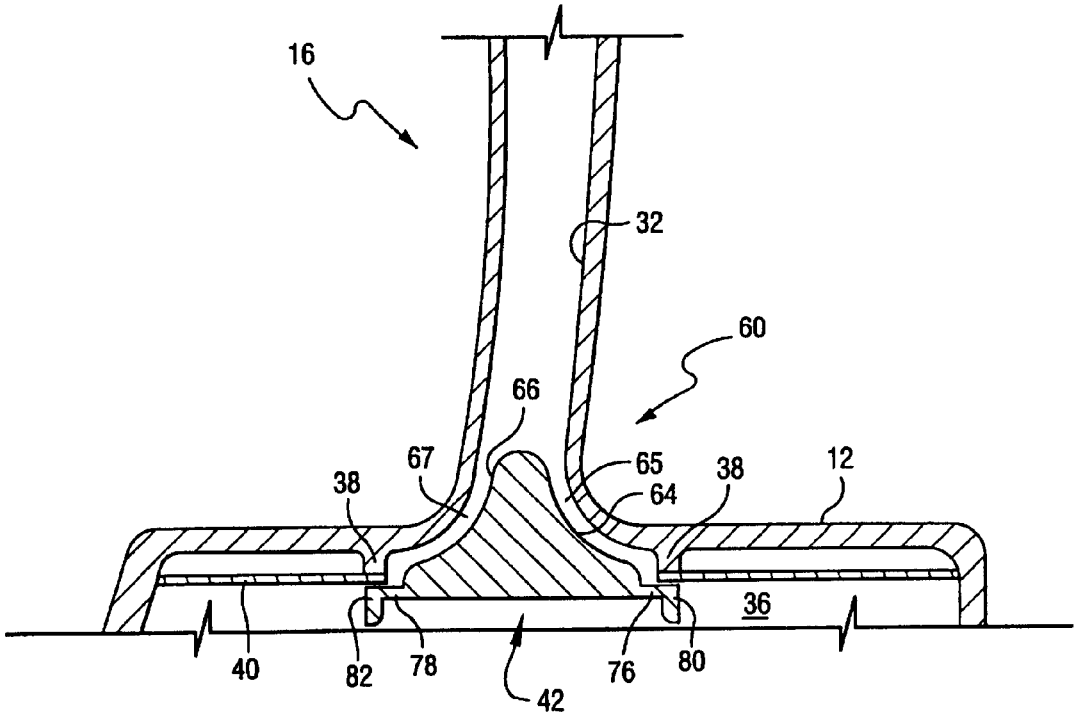
FIG. 3 is a schematic cross-sectional view taken along lines 3—3 of FIG. 1 showing a coolant flow splitter structure embodying the invention.

Projecting from the outer face 48 of the flow splitter base 44 is the main body 58 of the flow splitter 42, which is adapted to project into the fillet region 60 of a respective coolant cavity of the airfoil, as shown in particular in FIG. 3. The main body 58 of the flow splitter in the illustrated embodiment defines a crest or ridge 62 that is the peak of its extension into the respective coolant cavity and defines respective pressure side and suction side slopes 64, 66 from the crest to adjacent the longitudinal edges of the flow splitter base. In the illustrated embodiment, the crest 62 of the flow splitter 42 is generally smoothly contoured to deflect flow to gaps 65, 67 defined at the respective suction and pressure sides fillet regions.

As best illustrated in FIGS. 4 and 6, the main body 58 of the flow splitter has at least first and second portions 68, 70 of varying radial height. In the illustrated embodiment, the first portion 68, which extends from the leading edge of the flow splitter about ⅓ the length of the main body, has the greatest radial height and then transitions via transition portion 72 to the second portion 70, which has a relatively reduced radial height and extends for substantially the remainder of the length of the main body of the flow splitter. In the illustrated embodiment, a further radial height transition portion 74 is defined at the trailing edge of the flow splitter main body. As will be appreciated, the topography of the flow splitter enables the flow splitter to achieve a desired and required heat transfer coefficient in the fillet region to meet the part life requirements by varying the gap between the flow splitter and the fillet. This produces the desired coolant flow per unit area for achieving the desired heat transfer coefficients.

As illustrated, first and second longitudinal slots 76, 78 are defined along each longitudinal edge 54, 56 of the base of the flow splitter for cooling flow exiting the respective cavity. As mentioned above, a design is required to achieve cool efficiency while minimizing the amount of cooling flow required. The above described flow splitter structure allows the gap to be varied in order to achieve the required cooling effectiveness.

A second desired characteristic of the design is that the cooling medium exiting the fillet region 60 not disturb downstream cooling of other areas on the airfoil side wall, due to the presence of the flow splitter 42. So that exiting cooling medium does not disturb or minimally disturbs downstream cooling of other areas on the airfoil side wall, flow shields 80, 82 have been provided in an exemplary embodiment of the invention, projecting radially inwardly along each longitudinal side edge 54, 56 of the flow splitter base 44 adjacent the cooling flow slots 76, 78. The flow shields isolate the exiting coolant flow from the side wall impingement plate holes and therefore minimize interference with downstream cooling.

The flow splitter 42 embodying the invention has been characterized hereinabove as including a base 44 and a main body 58. It is to be understood that the base and main body may be integrally formed or may be separately formed as by casting and then welded or otherwise mechanically secured together, as schematically shown by retaining features 84, to define a flow splitter assembly.

Although the invention has been described hereinabove as embodied in a flow control structure disposed at the radially inner end of a vane, it is to be understood that a flow control structure embodying the invention could be disposed at the exit end of return cavity, at the radially outer end of a nozzle vane.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine vane segment for forming part of a nozzle stage of a turbine, comprising:

inner and outer walls spaced from one another;

a turbine vane extending between said inner and outer walls and having leading and trailing edges, said vane including a plurality of discrete cavities between the leading and trailing edges and extending lengthwise of said vane for flowing a cooling medium through said vane;

a plenum defined adjacent one of said inner and outer walls, at least one of said cavities of said vane being in flow communication with said plenum via an opening at a radial end of said vane to enable passage of cooling medium from said at least one cavity into said plenum; and a flow control structure for channeling cooling media flow to flow along and adjacent a fillet region defined at a transition between a wall of said vane and said one of said inner and outer walls for cooling said fillet region.

2. A turbine vane segment as in claim 1, wherein said flow control structure is mounted to one of said vane and said one of said inner and outer walls so as to define a gap with said fillet region.

3. A turbine vane segment as in claim 2, further comprising first and second exit flow slots defined along longitudinal side edges of said flow control structure to define a flow path for coolant flow exiting said cavity.

4. A turbine vane segment as in claim 3, further comprising first and second shields projecting radially from a base of said flow control structure, along said exit flow slots for isolating cooling exit flow.

5. A turbine vane segment as in claim 1, wherein said flow control structure comprises a base and a main body, said main body projecting into said opening of said cavity.

6. A turbine vane segment as in claim 5, wherein main body is configured to define a crest generally at a transverse mid portion of said base and to define slopped walls from said crest toward longitudinal side edges of said base, thereby to split flow exiting said cavity into flows along respective fillet regions on each side of said vane.

7. A turbine vane segment as in claim 6, wherein a radial height of said crest of said main body varies along a length of said main body.

8. A turbine vane segment as in claim 7, wherein said main body includes a first portion having a first radial height and extending from a leading edge thereof along a first portion of the length thereof and a second portion having a second, lesser radial height extending from adjacent a trailing end of said first portion along a second portion of the length of the main body.

9. A turbine vane segment as in claim 8, further comprising a radial height transition portion interconnecting said first and second portions of said main body.

10. A turbine vane segment as in claim 6, further comprising first and second exit flow slots defined along said longitudinal side edges of said base of said flow control structure to define a flow path for coolant flow exiting said cavity.

11. A turbine vane segment as in claim 10, further comprising first and second shields projecting radially from said base along said exit flow slots.

12. A turbine vane segment as in claim 11, further comprising an impingement plate mounted to said one of said inner and outer walls in spaced relation to an inner surface thereof, said impingement plate having holes for passage of the cooling medium for impingement cooling of said one of said inner and outer walls, whereby said flow shields isolate exiting coolant flow from said impingement plate holes.

13. A turbine vane segment as in claim 5, wherein said base of said flow control structure is mounted to said inner wall.

14. A turbine vane segment as in claim 5, wherein said base and said main body are separately formed and are mechanically secured together to define said flow control structure.

15. A method of cooling the fillet region of a nozzle comprising:

providing a nozzle vane segment including inner and outer walls spaced from one another; a turbine vane extending between said inner and outer walls and having leading and trailing edges, said vane including a plurality of discrete cavities between the leading and trailing edges and extending lengthwise of said vane for flowing a cooling medium through said vane; and a plenum defined adjacent one of said inner and outer walls, at least one of said cavities of said vane being in flow communication with said plenum via an opening at a radial end of said vane to enable passage of cooling medium from said at least one cavity into said plenum;

disposing a flow control structure at said opening;

flowing coolant medium through said cavity;

channeling said flowing coolant medium at said outlet with said flow control structure to a fillet region defined at a transition between a wall of said vane and said one of said inner and outer walls for cooling said fillet region.

16. A method as in claim 15, wherein said step of disposing a flow control structure at said opening comprises mounting said flow control structure to one of said vane and said one of said inner and outer walls so as to define a coolant flow gap with said fillet region.

17. A method as in claim 16, wherein said flow control structure comprises a base and a main body, said base is mounted to said one of said inner and outer walls and said main body is disposed to project into said opening of said cavity.

18. A method as in claim 17, wherein said main body is configured to define a crest generally at a transverse mid portion of said base and to define slopped walls from said crest toward longitudinal side edges of said base, whereby coolant flow exiting said cavity is split into flows along respective fillet regions on each side of said vane.

19. A flow control structure for channeling cooling media flow to a fillet region defined at a transition between a wall of a nozzle vane and a wall of a nozzle segment, for cooling the fillet region, comprising:

a base; and a main body, said main body being configured to define a crest generally at a transverse mid portion of said base and to define sloped walls from said crest toward longitudinal side edges of said base, thereby to define a gap with the fillet region to channel coolant flow along the fillet region.

20. A flow control structure as in claim 19, wherein a height of said crest of said main body varies along a length of said main body.

21. A flow control structure as in claim 20, wherein said main body includes a first portion having a first height and extending from a leading edge thereof along a first portion of the length thereof and a second portion having a second, lesser height extending from adjacent a trailing end of said first portion along a second portion of the length of the main body.

22. A flow control structure as in claim 21, further comprising a height transition portion interconnecting said first and second portions of said main body.

23. A flow control structure as in claim 19, further comprising first and second exit flow slots defined along said longitudinal side edges of said base to define a flow paths for spent coolant flow.

24. A flow control structure as in claim 23, further comprising first and second longitudinally extending shields projecting from a bottom face of said base along said exit flow slots.

25. A flow control structure as in claim 23, wherein said base and said main body are separately formed and are mechanically secured together.

* * * * *